US010622757B2

(12) United States Patent
Kawashima

(10) Patent No.: US 10,622,757 B2
(45) Date of Patent: Apr. 14, 2020

(54) CONNECTOR WITH RUBBER COVER

(71) Applicant: Sumitomo Wiring Systems, Ltd., Yokkaichi, Mie (JP)

(72) Inventor: Naomichi Kawashima, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/466,661

(22) PCT Filed: Nov. 17, 2017

(86) PCT No.: PCT/JP2017/041516
§ 371 (c)(1),
(2) Date: Jun. 5, 2019

(87) PCT Pub. No.: WO2018/105362
PCT Pub. Date: Jun. 14, 2018

(65) Prior Publication Data

US 2019/0312378 A1 Oct. 10, 2019

(30) Foreign Application Priority Data

Dec. 7, 2016 (JP) ..... 2016-237391

(51) Int. Cl.
*H01R 13/52* (2006.01)
*H01R 13/639* (2006.01)
*H01R 13/629* (2006.01)

(52) U.S. Cl.
CPC ..... *H01R 13/5221* (2013.01); *H01R 13/52* (2013.01); *H01R 13/5202* (2013.01);
(Continued)

(58) Field of Classification Search
CPC ..... H01R 13/5221; H01R 13/52; H01R 13/5202; H01R 13/5213; H01R 13/629; H01R 13/639
(Continued)

(56) References Cited

U.S. PATENT DOCUMENTS 4,611,872 A * 9/1986 Ito ..... H01R 13/5219 439/277
4,874,325 A * 10/1989 Bensing ..... H01R 13/5219 439/272

(Continued)

FOREIGN PATENT DOCUMENTS

JP 11-067350 3/1999
JP 3399305 2/2003

OTHER PUBLICATIONS

International Search Report dated Dec. 26, 2017.

*Primary Examiner* — Harshad C Patel
(74) *Attorney, Agent, or Firm* — Gerald E. Hespos; Michael J. Porco; Matthew T. Hespos

(57) ABSTRACT

A connector with rubber cover (10) includes a housing (20) connectable to a mating housing (71) and having an outer peripheral side surface extending in a connecting direction to the mating housing. A lever (60) includes lever bodies (62) having cam grooves (63) engageable with cam pins (72) on the mating housing, and an operating portion (61) is provided on ends of the lever bodies (62) so that the lever bodies (62) can be pushed. A back surface member is mounted on a back of the housing (20), and a tubular rubber cover (40) disposed along the outer peripheral side surface of the housing (20). The rubber cover (40) is mounted on the outer peripheral side surface of the housing (20) by the operating portion (61) of the lever (60) and the back surface member.

4 Claims, 9 Drawing Sheets

(52) U.S. Cl.
CPC ..... *H01R 13/5213* (2013.01); *H01R 13/629* (2013.01); *H01R 13/639* (2013.01)

(58) Field of Classification Search
USPC ..... 439/272, 271
See application file for complete search history.

(56) References Cited

U.S. PATENT DOCUMENTS

| | | | | | |
|---|---|---|---|---|---|
| 5,100,335 | A * | 3/1992 | Yamamoto | H01R 13/5219 | 439/271 |
| 5,158,391 | A * | 10/1992 | Fujitani | H01R 13/5202 | 403/288 |
| 5,389,005 | A * | 2/1995 | Kodama | H01R 13/5219 | 439/272 |
| 5,575,672 | A * | 11/1996 | Katsuma | B60T 8/368 | 439/157 |
| 7,249,958 | B2 * | 7/2007 | Ishikawa | H01R 13/631 | 439/140 |
| 9,306,316 | B2 * | 4/2016 | Aizawa | H01R 13/6598 | |
| 10,367,292 | B2 * | 7/2019 | Furuya | H01R 13/5202 | |
| 2003/0017739 | A1 * | 1/2003 | Sawayanagi | H01R 13/5202 | 439/357 |
| 2013/0309897 | A1 | 11/2013 | De Villeroche | | |

* cited by examiner

CONNECTOR WITH RUBBER COVER

BACKGROUND

Field of the Invention

This specification relates to a connector with rubber cover.

Related Art

The Publication of Japanese Patent No. 3399305 discloses a connector waterproofed by covering a connector housing by a grommet. This connector includes a waterproof-side connector housing that includes a housing body accommodating a female terminal fitting. The grommet is made of rubber and is in the form of a box open in a lower surface. The grommet is mounted to cover the upper surface and the outer peripheral surface of the housing body. A grommet cover is made of resin and is in the form of a box open in a lower surface. The grommet cover is mounted on the grommet In paragraph 0012 of the specification of the Publication of Japanese Patent No. 3399305 it is described that "although not shown, a tubular wire pull-out portion is formed on the upper surface of the grommet 22 and extends outward through the grommet cover 23". However, a specific structure of the tubular wire pull-out portion is not described at all and both a sealing structure for sealing between the inner peripheral surface of the wire pull-out portion and the outer peripheral surface of the wire and a sealing structure for sealing between the grommet cover 23 and the wire pull-out portion are unknown. Thus, the Publication of Japanese Patent No. 3399305 discloses no specific sealing structure. As just described, a technique for waterproofing a connector by a sealing member, such as a grommet, has not been established yet.

SUMMARY

A connector with rubber cover disclosed by this specification includes a housing connectable to a mating housing and having an outer peripheral side surface orthogonal to a connection surface to the mating housing. The connector also has a lever with a lever body having a cam groove engageable with a cam pin provided on the mating housing. An operating portion is provided on an end part of the lever body and enables a pushing operation of the lever body. A back surface member is to be mounted on a back surface of the housing, and a tubular rubber cover is disposed along the outer peripheral side surface of the housing. The rubber cover is mounted on the outer peripheral side surface of the housing by the operating portion of the lever and the back surface member.

According to this configuration, the rubber cover is mounted on the outer peripheral side surface of the housing. Thus, water cannot intrude into the housing. If the rubber cover merely is disposed along the outer peripheral side surface of the housing, a clearance will be formed between the outer peripheral side surface of the housing and the rubber cover, and water may intrude into the housing through this clearance. However, the rubber cover is mounted on the outer peripheral side surface of the housing by the operating portion of the lever and the back surface member. Thus, no clearance is formed, and a sufficient sealing function can be exhibited.

The mating housing may project from a mating casing, and the rubber cover may include an annular lip to be held in close contact with the mating casing. According to this configuration, the intrusion of water to connecting parts of the housing and the mating housing can be avoided by holding the annular lip in close contact with the mating casing.

The rubber cover may include a pressed portion to be pressed by the operating portion of the lever, and the pressed portion may be provided with a lever insertion hole through which the lever body of the lever is inserted. According to this configuration, the lever body of the lever is inserted into the housing through the lever insertion hole of the pressed portion. Thus, a cam action can be exhibited by the engagement of the cam pin and the cam groove. Further, the intrusion of water from the lever insertion hole can be avoided by the surface contact of the operating portion of the lever with the pressed portion.

The operating portion may be provided with a lock projection, and the housing may be provided with a locked portion for holding the operating portion in a state pressing the pressed portion by having the lock projection locked thereto. According to this configuration, the operating portion can be held in the state pressing the pressed portion by locking the lock projection of the operating portion to the locked portion of the housing. Further, the operating portion is returned by the resilience of the rubber cover if the lock projection is not locked to the locked portion. Thus, an incompletely connected state can be detected.

The back surface member may be a resin cover open forward, and an opening edge part of the resin cover may be in contact with outer surfaces of the rubber cover except a surface on the side of the operating portion. According to this configuration, the rubber cover can be mounted on the outer peripheral side surface of the housing by the operating portion and the opening edge part of the resin cover while avoiding interference of the operating portion and the opening edge part of the resin cover.

According to the invention, the connector with rubber cover can be waterproofed by mounting the rubber cover on the outer peripheral side surface of the housing by the operating portion of the lever and the back surface member.

DETAILED DESCRIPTION

Figure 1:
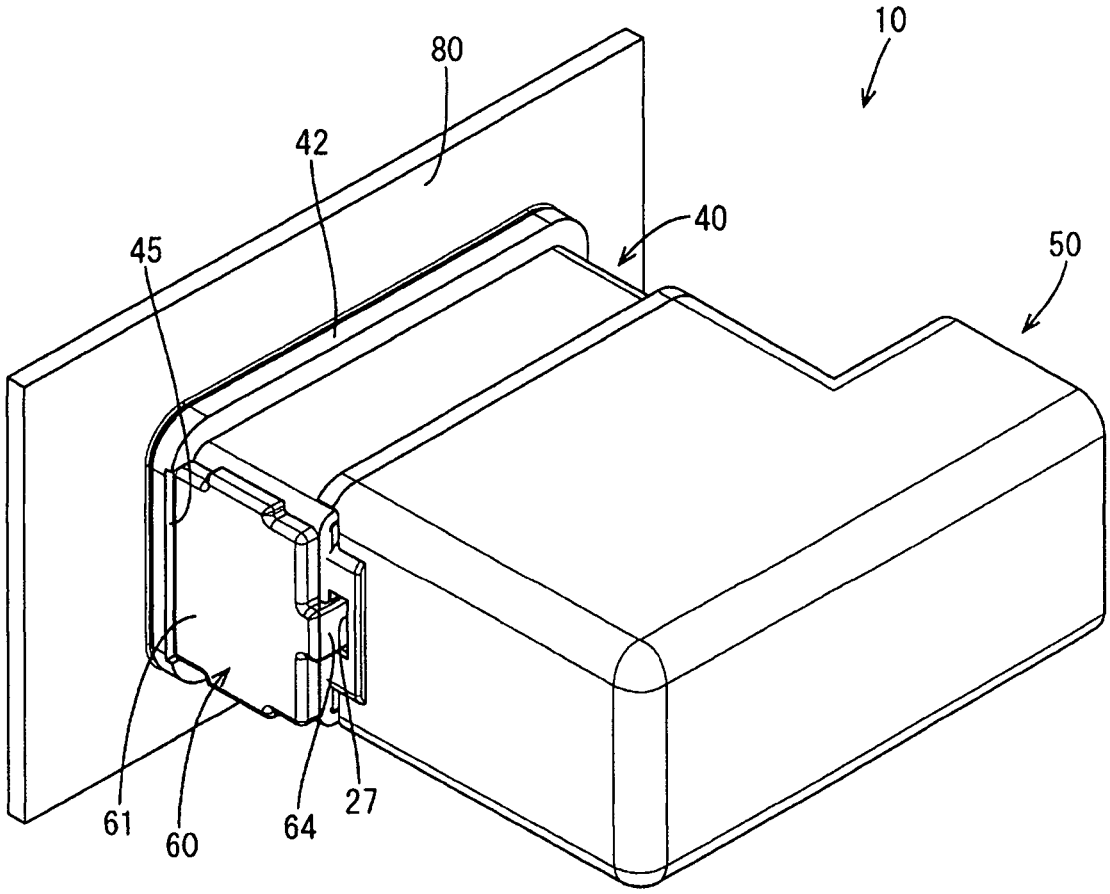
FIG. 1 is a perspective view showing a connected state of a connector with rubber cover when obliquely viewed from behind.
Figure 6:
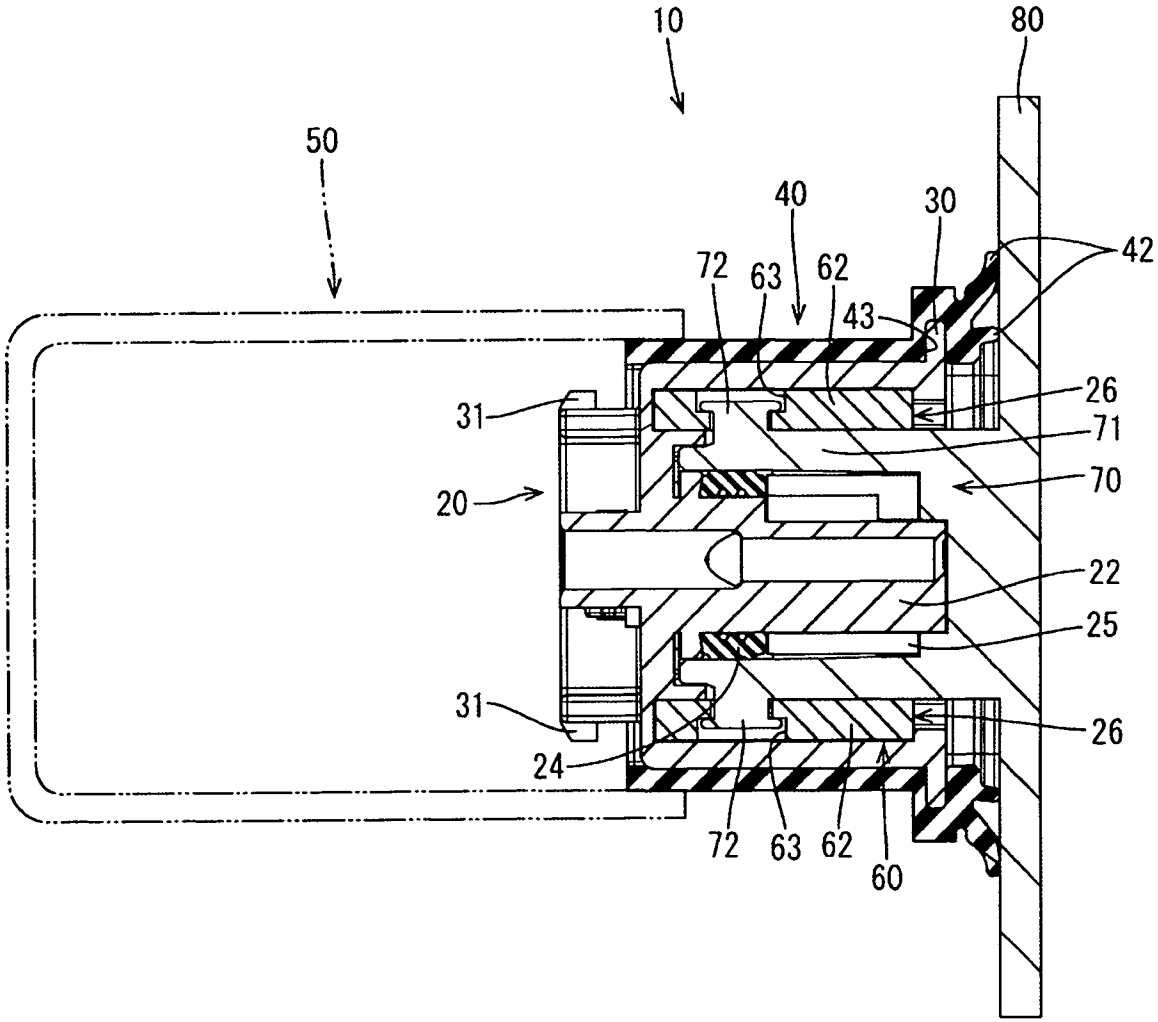
FIG. 6 is a section along A-A in FIG. 5.

Hereinafter, an embodiment is described with reference to FIGS. 1 to 9. A connector with rubber cover 10 of this embodiment is connectable to a mating connector 70 that projects on a mating casing 80, as shown in FIGS. 1 and 6. In the following description, connection surface sides of the connectors 10, 70 are referred to as front ends.

As shown in FIG. 6, the mating connector 70 includes a forwardly open receptacle 71. Upper and lower cam pins 72 stand on the outer surface of the receptacle 71. The upper cam pin 72 projects up from the upper surface of the receptacle 71 and the lower cam pin 72 projects down from the lower surface of the receptacle 71.

As shown in FIG. 6, the connector with rubber cover 10 includes a housing 20 made of synthetic resin. A rubber cover 40 is disposed along an outer peripheral side surface of the housing 20, and a resin cover 50 is to be assembled with the housing 20 from behind. A lever 60 is assembled laterally with the housing 20.

Figure 3:
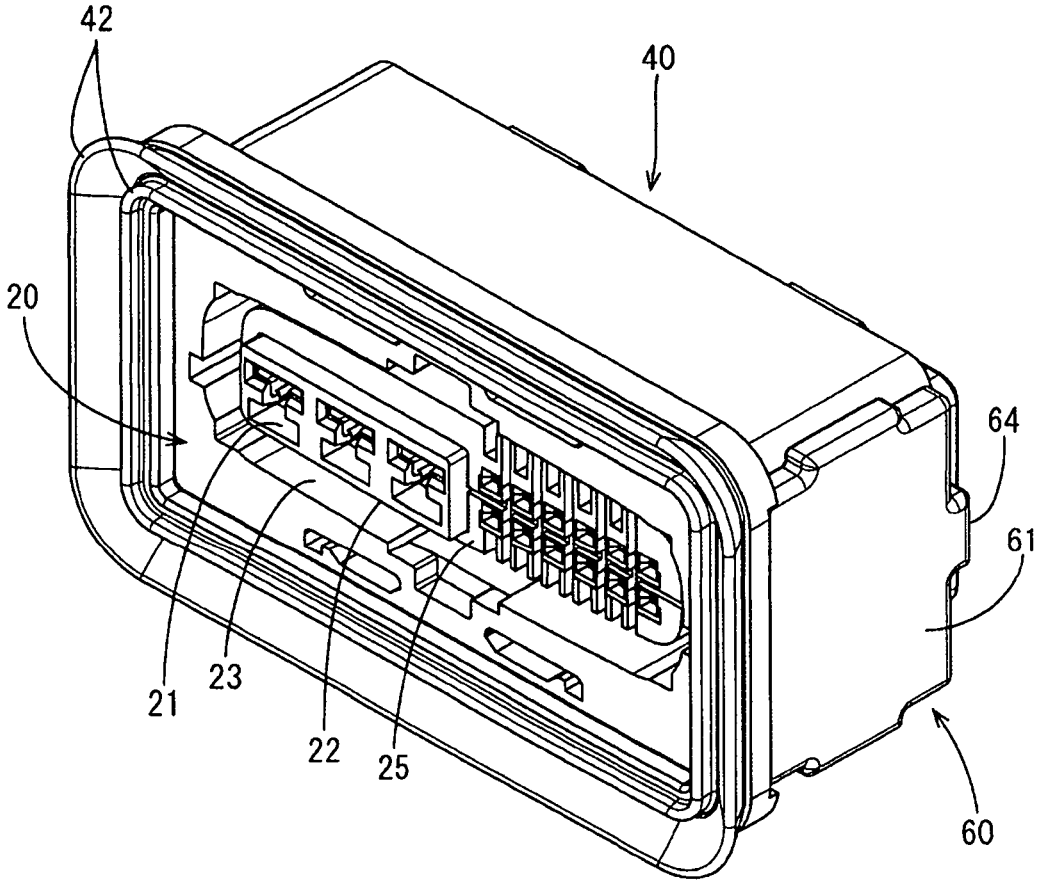
FIG. 3 is a perspective view of the connector with rubber cover with the resin cover removed when obliquely viewed from front.
Figure 4:
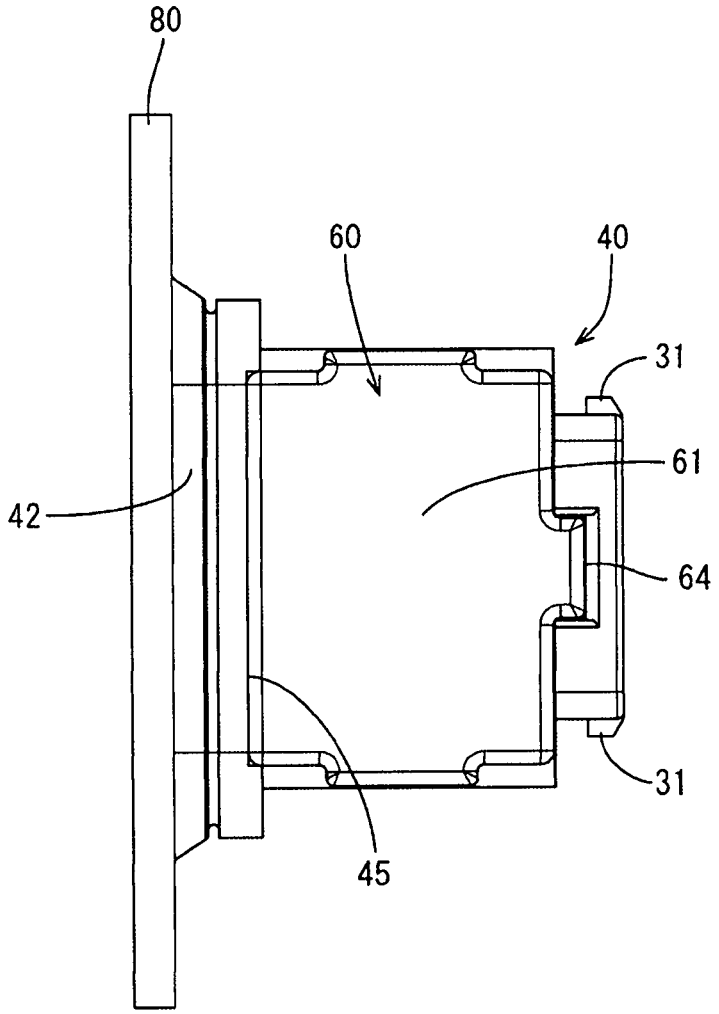
FIG. 4 is a side view of the connector with rubber cover with the resin cover removed when viewed from the side of an operating portion.
Figure 5:
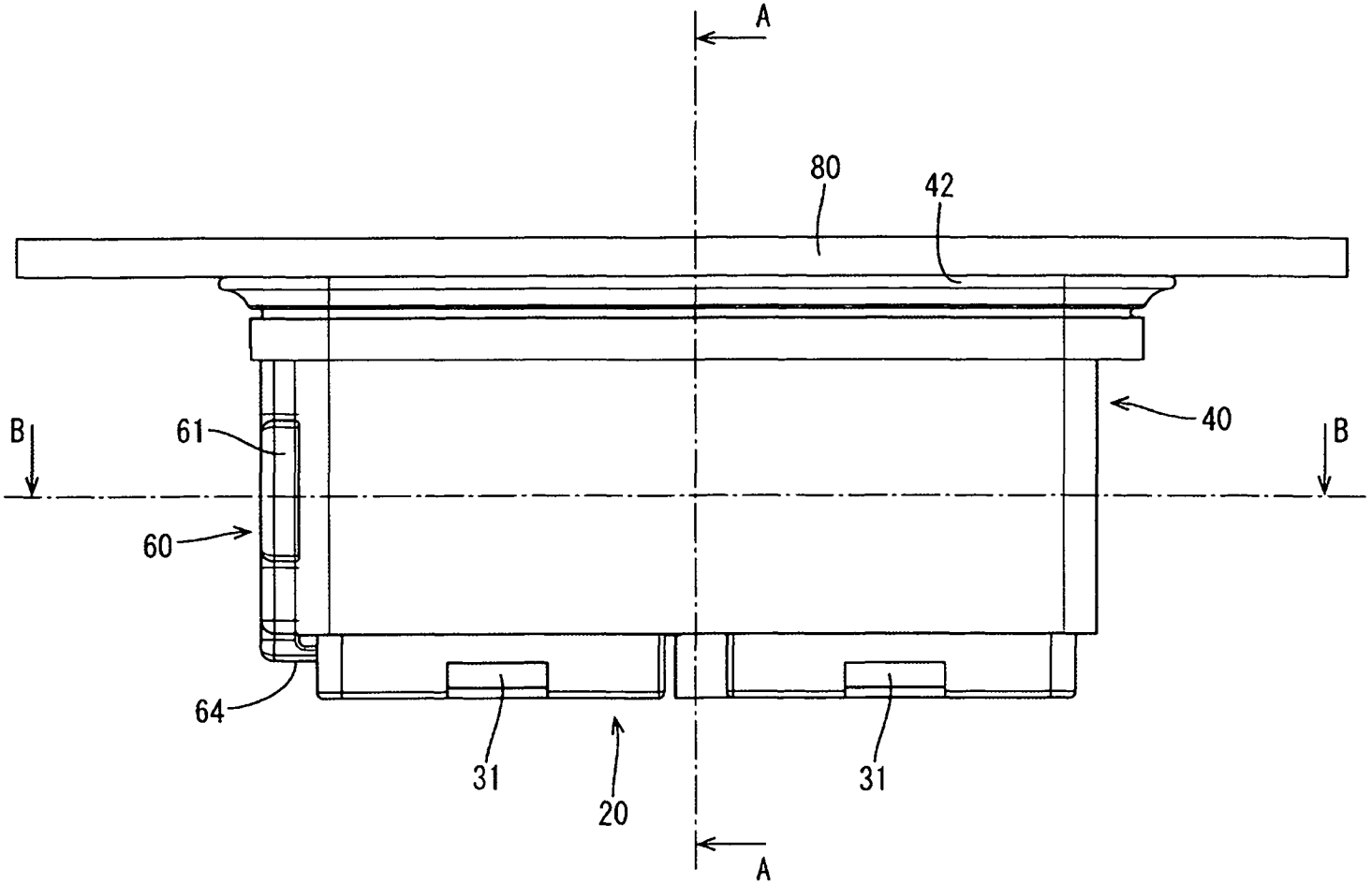
FIG. 5 is a plan view showing the connected state of the connector with rubber cover with the resin cover removed when viewed from above.

As shown in FIG. 3, the housing 20 includes a terminal accommodating portion 22 formed with cavities 21 for accommodating unillustrated terminals. The terminal accommodating portion 22 is laterally long, and a receptacle entrance space 23 is formed on the outer periphery of the terminal accommodating portion 22 for receiving the receptacle 71 of the mating connector 70.

Figure 8:
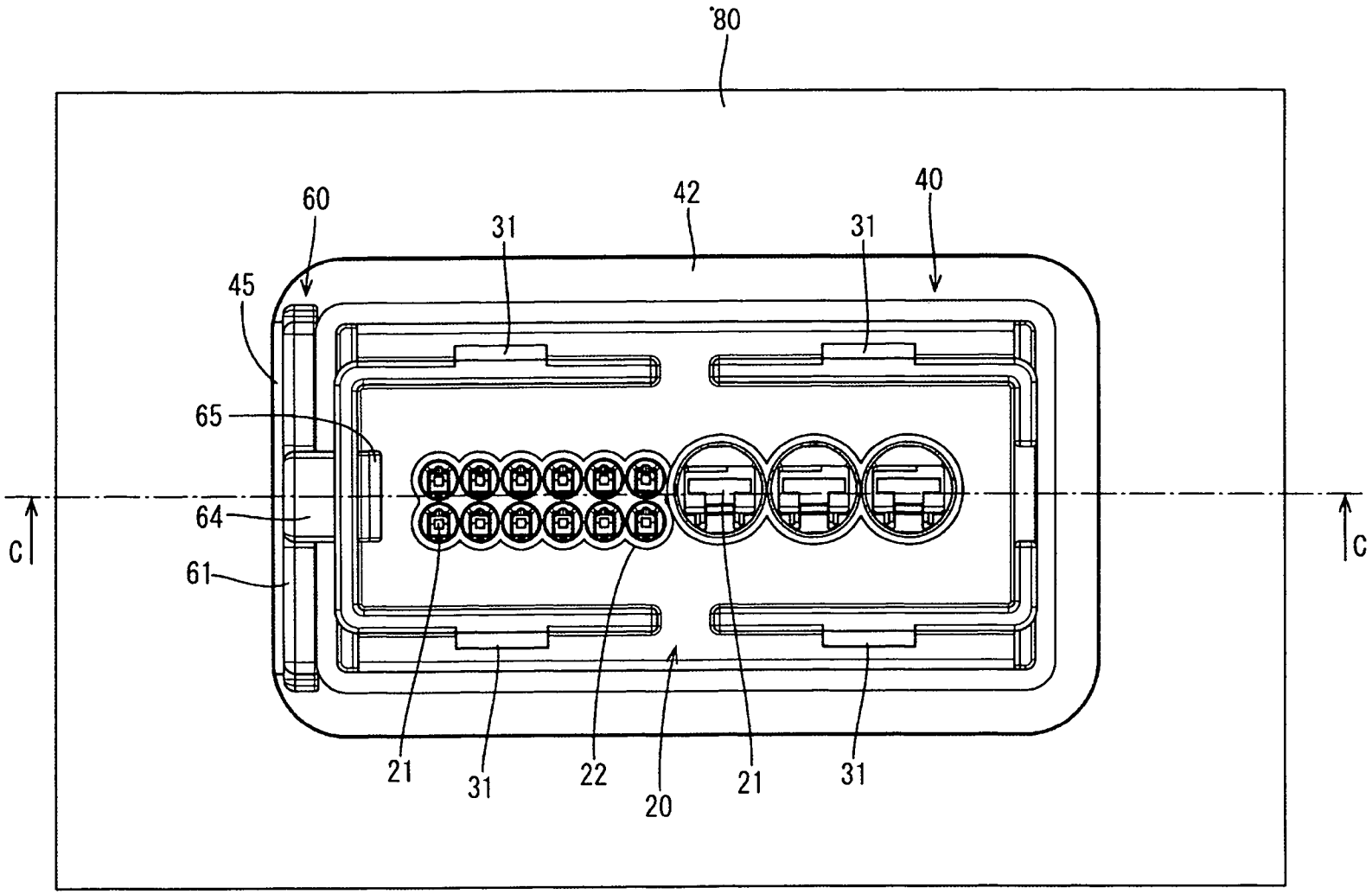
FIG. 8 is a back view showing the connected state of the connector with rubber cover with the resin cover removed when viewed from behind.

As shown in FIG. 8, a rear end of the cavity 21 has a circular shape, and an unillustrated rubber plug is mounted therein. The rubber plug is formed with a wire insertion hole allowing the passage of an unillustrated wire therethrough. The rubber plug is sandwiched between the outer peripheral surface of the wire and the inner peripheral surface of the cavity to prevent intrusion of water into a rear end opening of the cavity 21.

Figure 9:
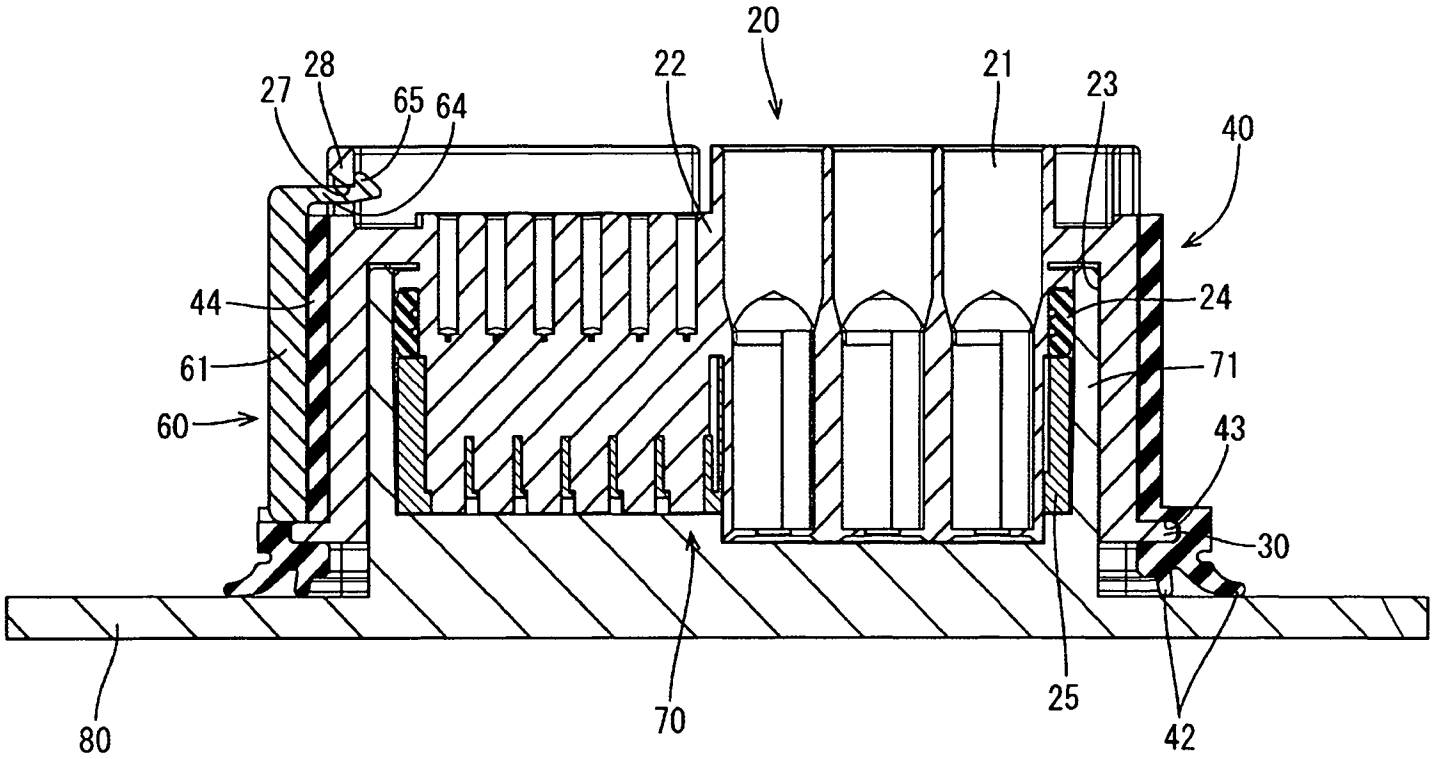
FIG. 9 is a section along C-C in FIG. 8.

As shown in FIG. 9, a rubber ring 24 is fit on the outer peripheral surface of the terminal accommodating portion 22. Further, a front retainer 25 is mounted on the outer peripheral surface of the terminal accommodating portion 22 before the rubber ring 24 to prevent forward detachment of the rubber ring 24.

Figure 7:
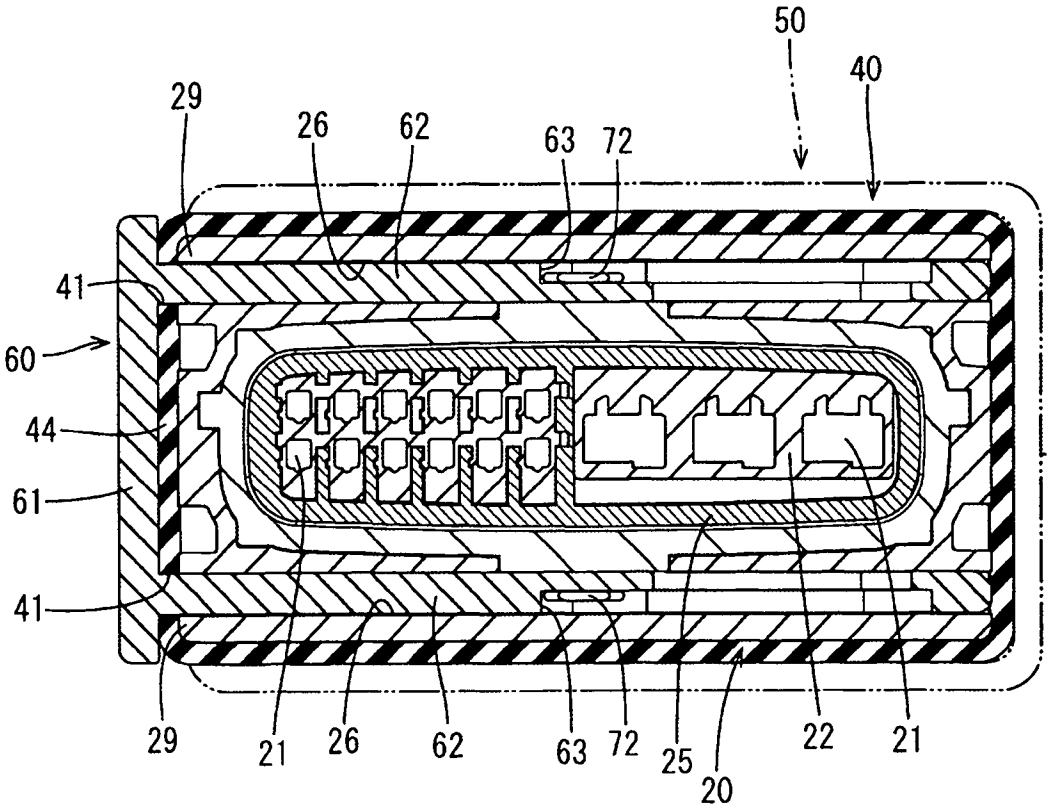
FIG. 7 is a section along B-B in FIG. 5.

As shown in FIG. 7, the lever 60 includes a plate-like operating portion 61 and two lever bodies 62 project in a plate thickness direction from the operating portion 61. The operating portion 61 is exposed outside the connector with rubber cover 10, as shown in FIG. 1. However, the two lever bodies 62 are accommodated inside the housing 20. As shown in FIG. 6, upper and lower lever accommodating portions 26 are provided on both upper and lower sides of the terminal accommodating portion 22 inside the housing 20 for accommodating the lever bodies 62 of the lever 60.

Each lever body 62 is provided with a cam groove 63 engageable with the cam pin 72. When the lever bodies 62 are inserted into the lever accommodating portions 26 and the operating portion 61 is pushed, the connector with rubber cover 10 is pulled toward the mating connector 70 by a cam action by the engagement of the cam pins 72 of the mating connector 70 and the cam grooves 63 of the lever bodies 62. The connector with rubber cover 10 and the mating connector 70 reach a properly connected state when the pushing operation of the lever bodies 62 by the operating portion 61 is completed.

Figure 2:
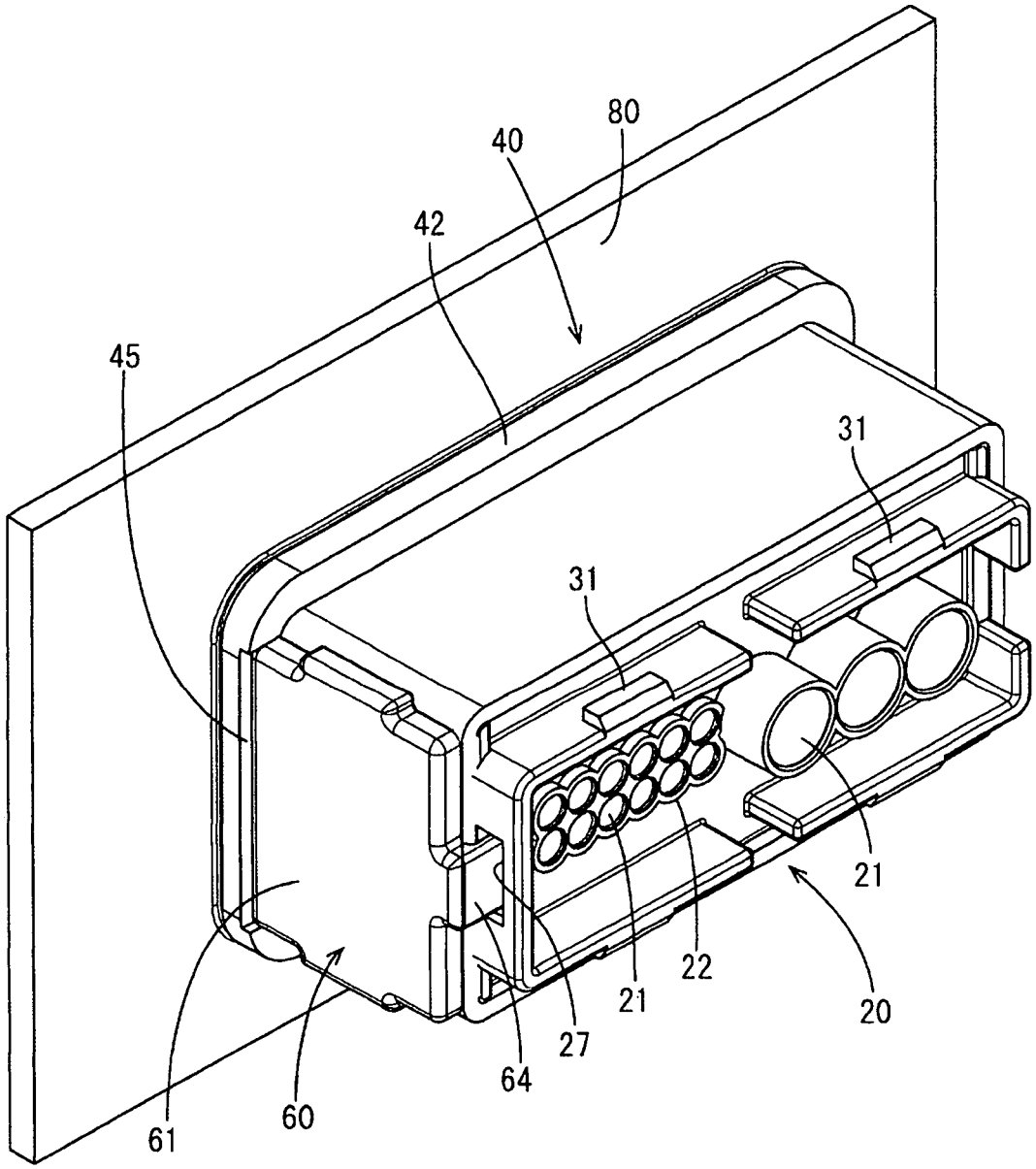
FIG. 2 is a perspective view showing the connected state of the connector with rubber cover with a resin cover removed when obliquely viewed from behind.

As shown in FIG. 2, a lock piece 64 is provided on a side edge of the operating portion 61. On the other hand, the housing 20 is provided with a lock hole 27 into which the lock piece 64 is inserted. As shown in FIG. 9, a lock projection 65 is provided on the tip of the lock piece 64 and the lever 60 is held in the housing 20. The connectors 10, 70 are held in the properly connected state by locking this lock projection 65 to a hole edge part 28 of the lock hole 27.

As shown in FIG. 7, the rubber cover 40 is in the form of a rectangular tube and is disposed along the outer peripheral side surface of the housing 20. The outer peripheral side surface of the housing 20 extends in a connecting direction to the mating connector 70 and defines a continuous surface composed of the upper, lower, left side and right side surfaces of the housing shown in FIG. 7. The rubber cover 40 is provided with two lever insertion holes 41 at positions corresponding to the lever accommodating portions 26. The lever bodies 62 of the lever 60 are inserted into the lever insertion holes 41.

As shown in FIGS. 6 and 9, two annular lips 42 are provided circumferentially on a front end opening edge of the rubber cover 40. Each annular lip 42 is in close contact with the mating casing 80 so that water does not intrude into the housing 20 along the receptacle 71 from the mating casing 80. Note that a flange 30 to be mounted into a mounting recess 43 of the rubber cover 40 is provided circumferentially on the front end opening edge of the housing 20. Pressing the flange 30 toward the mating casing 80 presses the two annular lips 42 against the mating casing 80 for double sealing. As shown in FIG. 1, a cutout 45 is set in the outer surface of the annular lip 42 for preventing interference with the operating portion 61.

As shown in FIG. 1, the resin cover 50 is mounted on a rear surface side of the housing 20 and is formed into an L shape to bend the wires pulled out rearward from the housing 20 substantially at a right angle and to pull the wires out laterally. As shown in FIG. 6, cover locks 31 are provided on the rear surface of the housing 20 and hold the resin cover 50. The resin cover 50 is mounted and held on the rear surface of the housing 20 by locking the cover locks 31 to unillustrated lock receiving portions of the resin cover 50. The resin cover 50 is open forward and is in contact with three surfaces of the rubber cover 40 except a surface on the side of the operating portion 61, as shown in FIG. 7.

As shown in FIG. 6, the resin cover 50 is held on the housing 20 so that an open front part thereof is located on a rear part of the rubber cover 40, and the rear part of the rubber cover 40 is sandwiched between the open front part of the resin cover 50 and the rear end of the outer peripheral side surface of the housing 20. Thus, the rubber cover 40 is mounted on the outer peripheral side surface of the housing 20 so that no clearance is formed between the rubber cover 40 and the outer peripheral side surface of the housing 20, and water does not intrude from behind the housing 20.

The rubber cover 40 is in the form of a rectangular tube disposed along the outer peripheral surface of the housing 20 and includes, as shown in FIG. 7, a pressed portion 44 to be pressed by the operating portion 61 of the lever 60. With the lock projection 65 of the lever 60 locked to the edge 28 of the lock hole 27 of the housing 20, the pressed portion 44 of the rubber cover 40 is sandwiched between the operating portion 61 and the outer peripheral side surface of the housing 20. The aforementioned lever insertion holes 41 are provided in the pressed portion 44. Thus, edges of the lever insertion holes 41 are sandwiched between the operating portion 61 of the lever 60 and openings 29 of the lever accommodating portions 26, and water does not intrude into the housing 20 through the lever accommodating portions 26 from the lever insertion holes 41.

Note that if the lock projection 65 of the lever 60 is not locked to the hole edge part 28 of the lock hole 27 of the housing 20, the operating portion 61 is returned by the resilience of the pressed portion 44. Therefore, it can be detected that the connector with rubber cover 10 is connected incompletely.

As described above, the rubber cover 40 is mounted on the outer peripheral side surface of the housing 20 in this embodiment so that water cannot intrude into the housing 20. If the rubber cover 40 merely was disposed along the outer peripheral side surface of the housing 20, a clearance would be formed between the outer peripheral side surface of the housing 20 and the rubber cover 40 and water may intrude into the housing 20 through this clearance. However, the rubber cover 40 is mounted on the outer peripheral side surface of the housing 20 by the operating portion 61 of the lever 60 and a back surface member (resin cover 50). Thus, no clearance is formed, and a sufficient sealing function can be exhibited.

A mating housing (receptacle 71) may project from the mating casing, and the rubber cover 40 may include the annular lips 42 to be held in close contact with the mating casing 80. According to this configuration, the annular lips 42 are held in close contact with the mating casing 80 so that water cannot intrude to connecting parts of the housing 20 and the mating housing.

The rubber cover 40 may include the pressed portion 44 to be pressed by the operating portion 61 of the lever 60, and the pressed portion 44 may be provided with the lever insertion holes 41 through which the lever bodies 62 of the lever 60 are inserted. According to this configuration, the lever bodies 62 of the lever 60 are inserted into the housing 20 through the lever insertion holes 41 of the pressed portion 44 so that a cam action is exhibited by the engagement of the cam pins 72 and the cam grooves 63. Further, the surface contact of the operating portion 61 of the lever 60 with the pressed portion 44 prevents water from intruding through the lever insertion holes 41.

The operating portion 61 may be provided with the lock projection 65 and the housing 20 may be provided with a locked portion (hole edge part 28) for holding the operating portion 61 in a state pressing the pressed portion 44 by having the lock projection 65 locked thereto. According to this configuration, a state where the operating portion 61 is pressing the pressed portion 44 can be held by locking the lock projection 65 of the operating portion 61 to the locked portion of the housing 20. Further, the operating portion 61 is returned by the resilience of the rubber cover 40 if the lock projection 65 is not locked to the locked portion so that an incompletely connected state can be detected.

The back surface member may be the forwardly open resin cover 50, and the opening edge of the resin cover 50 may be in contact with the outer surfaces of the rubber cover 40 except the surface on the side of the operating portion 61. According to this configuration, the rubber cover 40 can be mounted on the outer peripheral side surface of the housing 20 by the operating portion 61 and the opening edge part of the resin cover 50 while avoiding interference of the operating portion 61 and the opening edge part of the resin cover 50.

The invention is not limited to the above described and illustrated embodiment. For example, the following various modes also are included.

Although the rubber cover 40 is a rectangular tube in the above embodiment, the rubber cover 40 may have any other tubular shape.

The annular lips 42 to be held in close contact with the mating casing 80 are provided in the above embodiment. However, annular lip(s) to be held in close contact with the receptacle 71 of the mating connector 70 may be provided.

The rubber cover 40 is provided with the lever insertion holes 41 in the above embodiment. However, cam pin insertion holes allowing the cam pins to project outward of the rubber cover 40 may be provided instead of the lever insertion holes 41.

Although the operating portion 61 is provided with the lock projection 65 in the above embodiment, the lever body 62 may be provided with a lock projection.

The resin cover 50 is illustrated as the back surface member in the above embodiment. However, a back retainer for retaining a one-piece rubber plug may be used as a back surface member in a connector in which the one-piece rubber plug is used to collectively cut off water entering cavities.

LIST OF REFERENCE SIGNS

10 . . . connector with rubber cover
20 . . . housing
28 . . . hole edge (locked portion)
40 . . . rubber cover
41 . . . lever insertion hole
42 . . . annular lip
44 . . . pressed portion
50 . . . resin cover (back surface member)
60 . . . lever
61 . . . operating portion
62 . . . lever body
63 . . . cam groove
65 . . . lock projection
71 . . . receptacle (mating housing)
72 . . . cam pin
80 . . . mating casing

The invention claimed is:

1. A connector with rubber cover, comprising:

a housing connectable to a mating housing projecting from a mating casing and having an outer peripheral side surface extending in a connecting direction to the mating housing;

a lever including a lever body having a cam groove engageable with a cam pin provided on the mating housing and an operating portion provided on an end part of the lever body and enabling a pushing operation of the lever body;

a back surface member to be mounted on a back surface side of the housing; and a tubular rubber cover disposed along the outer peripheral side surface of the housing;

the rubber cover being mounted on the outer peripheral side surface of the housing by the operating portion of the lever and the back surface member;

the rubber cover including an annular lip to be held in close contact with the mating casing and a mounting recess formed by being recessed at a position behind the annular lip in an outer circumferential direction;

a flange to be mounted into the mounting recess and being circumferentially provided on an opening edge of the housing on the side of the mating casing; and the annular lip being pressed against the mating casing by the flange by the housing being pulled toward the mating casing by the lever.

2. The connector with rubber cover of claim 1, wherein the rubber cover includes a pressed portion to be pressed by the operating portion of the lever, and the pressed portion is provided with a lever insertion hole through which the lever body of the lever is inserted.

3. The connector with rubber cover of claim 2, wherein the operating portion is provided with a lock projection, and the housing is provided with a locked portion for holding the operating portion in a state pressing the pressed portion by having the lock projection locked thereto.

4. The connector with rubber cover of claim 3, wherein:

the back surface member is a resin cover open forward; and an opening edge part of the resin cover is in contact with outer surfaces of the rubber cover except a surface on a side of the operating portion.

* * * * *